US012329240B2

(12) United States Patent
Thompsett et al.

(10) Patent No.: US 12,329,240 B2
(45) Date of Patent: Jun. 17, 2025

(54) SOLE ELEMENT

(71) Applicant: adidas AG, Herzogenaurach (DE)

(72) Inventors: Benjamin Alexander Thompsett, Nuremberg (DE); James Slack, Nuremberg (DE); David Artner, Nuremberg (DE); Tomson Wang, Jiangsu Province (CN); Junus Ali Khan, Richland, WA (US); Arjun Shanker, Richland, WA (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/618,769

(22) Filed: Mar. 27, 2024

(65) Prior Publication Data

US 2024/0237778 A1 Jul. 18, 2024

Related U.S. Application Data

(62) Division of application No. 16/941,061, filed on Jul. 28, 2020, now Pat. No. 11,944,158.

(30) Foreign Application Priority Data

Sep. 3, 2019 (CN) ..... 201910826126.7
Sep. 3, 2019 (DE) ..... 10 2019 213 330.4

(51) Int. Cl.
*A43B 5/02* (2006.01)
*A43B 5/18* (2006.01)
*A43B 13/14* (2006.01)

(52) U.S. Cl.
CPC ..... *A43B 5/02* (2013.01); *A43B 5/185* (2013.01); *A43B 13/14* (2013.01)

(58) Field of Classification Search
CPC ..... A43B 13/14; A43B 13/141; A43B 13/026; A43B 13/125; A43B 5/185; A43B 5/02
See application file for complete search history.

(56) References Cited

U.S. PATENT DOCUMENTS 3,195,244 A * 7/1965 Whitcas ..... A43B 5/008 36/130
5,052,130 A 10/1991 Barry et al.
5,142,797 A 9/1992 Cole, III
6,973,746 B2 12/2005 Auger et al.
(Continued)

FOREIGN PATENT DOCUMENTS

CN 12825851 A 8/1999
CN 1282551 A 2/2001
(Continued)

OTHER PUBLICATIONS

Extended European Search Report for European Application No. 201946902, mailed on Feb. 23, 2021, 7 pages.
(Continued)

*Primary Examiner* — Bao-Thieu L Nguyen
(74) *Attorney, Agent, or Firm* — Sterne, Kessler, Goldstein & Fox P.L.L.C.

(57) ABSTRACT

This invention concerns a sole element for a cleated article of footwear, in particular for a football shoe. The sole element includes a composite element with an anisotropic bending property. The sole element further includes a polymer element, and the polymer element at least partially covers the composite element of the sole element.

18 Claims, 4 Drawing Sheets

(56) References Cited

U.S. PATENT DOCUMENTS

| | | | | |
|---|---|---|---|---|
| 8,356,428 | B2 | 1/2013 | Auger et al. | |
| 8,713,819 | B2 * | 5/2014 | Auger | A43D 29/00 36/76 R |
| 9,462,845 | B2 * | 10/2016 | Auger | A43D 29/00 |
| 9,549,589 | B2 * | 1/2017 | Auger | A43B 5/02 |
| 9,615,621 | B2 * | 4/2017 | Foxen | A43B 5/06 |
| 9,839,255 | B2 * | 12/2017 | Adami | B29D 35/142 |
| 11,439,206 | B2 * | 9/2022 | Santos | A43B 9/12 |
| 11,944,158 | B2 * | 4/2024 | Thompsett | A43B 5/02 |
| 2006/0225305 | A1 * | 10/2006 | Morgan | A43B 1/0027 36/59 R |
| 2007/0266597 | A1 | 11/2007 | Jones | |
| 2009/0031584 | A1 | 2/2009 | Rasmussen et al. | |
| 2010/0083539 | A1 | 4/2010 | Norton | |
| 2010/0126043 | A1 | 5/2010 | Loverin et al. | |
| 2010/0154258 | A1 | 6/2010 | Scholz et al. | |
| 2010/0307025 | A1 | 12/2010 | Truelsen et al. | |
| 2011/0030245 | A1 | 2/2011 | Truelsen | |
| 2012/0036740 | A1 | 2/2012 | Gerber | |
| 2012/0180343 | A1 * | 7/2012 | Auger | A43B 1/0009 12/146 B |
| 2013/0067765 | A1 | 3/2013 | Auger et al. | |
| 2014/0202039 | A1 | 7/2014 | Geer et al. | |
| 2014/0331418 | A1 * | 11/2014 | Auger | A43D 29/00 12/146 B |
| 2014/0338230 | A1 * | 11/2014 | Auger | A43C 15/02 36/30 R |
| 2015/0089841 | A1 | 4/2015 | Smaldone et al. | |
| 2015/0223561 | A1 | 8/2015 | Kilgore et al. | |
| 2015/0282557 | A1 | 10/2015 | Kirk et al. | |
| 2016/0000180 | A1 | 1/2016 | Cook et al. | |
| 2016/0037857 | A1 * | 2/2016 | Foxen | A43B 7/1485 36/103 |
| 2016/0192739 | A1 | 7/2016 | Hoffer et al. | |
| 2016/0278484 | A1 * | 9/2016 | Aslani | A43B 5/02 |
| 2017/0079378 | A1 | 3/2017 | Farris et al. | |
| 2017/0095033 | A1 | 4/2017 | Farina et al. | |
| 2017/0157893 | A1 * | 6/2017 | Simmons | A43B 13/026 |
| 2017/0164691 | A1 | 6/2017 | Baucom et al. | |
| 2017/0196304 | A1 | 7/2017 | Haughbro et al. | |
| 2017/0202301 | A1 | 7/2017 | Amis et al. | |
| 2017/0238652 | A1 | 8/2017 | Langvin | |
| 2017/0303627 | A1 * | 10/2017 | Weidl | A43B 3/246 |
| 2018/0055143 | A1 | 3/2018 | Baucom et al. | |
| 2018/0132564 | A1 | 5/2018 | Bruce et al. | |
| 2018/0168281 | A1 | 6/2018 | Case et al. | |
| 2018/0177261 | A1 | 6/2018 | Amis et al. | |
| 2018/0199665 | A1 | 7/2018 | Luedecke et al. | |
| 2018/0222148 | A1 | 8/2018 | Simmons et al. | |
| 2018/0338568 | A1 | 11/2018 | Chambers et al. | |
| 2018/0343979 | A1 * | 12/2018 | Yoshida | A43C 15/02 |
| 2019/0150563 | A1 | 5/2019 | Shorten | |
| 2019/0223553 | A1 | 7/2019 | Lussier et al. | |
| 2019/0357627 | A1 | 11/2019 | Shankar et al. | |
| 2019/0373981 | A1 | 12/2019 | Luh | |
| 2022/0110406 | A1 | 4/2022 | Salari-Sharif et al. | |
| 2022/0273071 | A1 * | 9/2022 | Remmele | B29D 35/0018 |
| 2023/0346075 | A1 * | 11/2023 | Thompsett | A43C 13/04 |

FOREIGN PATENT DOCUMENTS

| | | | |
|---|---|---|---|
| CN | 101756419 | A | 6/2010 |
| CN | 102406276 | A | 4/2012 |
| CN | 103945721 | A | 7/2014 |
| CN | 105795578 | A | 7/2016 |
| CN | 108024593 | A | 5/2018 |
| CN | 109549285 | A | 4/2019 |
| DE | 4120136 | A1 | 12/1992 |
| DE | 10 2008 064 493 | A1 | 6/2010 |
| EP | 0857435 | A2 | 8/1998 |
| EP | 2 755 516 | A2 | 7/2014 |
| GB | 2256784 | A | 12/1992 |
| JP | 2005160727 | A | 6/2005 |
| JP | 2005185748 | A | 7/2005 |
| JP | 2005-261750 | A | 9/2005 |
| JP | 2010-148880 | A | 7/2010 |
| JP | 2015198931 | A | 11/2015 |
| JP | 2015204984 | A | 11/2015 |
| JP | 2018529461 | A | 10/2018 |
| JP | 2019130304 | A | 8/2019 |
| TW | 228469 | B | 8/1994 |
| WO | WO 2013/039701 | A2 | 3/2013 |
| WO | WO 2018/118430 | A1 | 6/2018 |

OTHER PUBLICATIONS

European Search Report in European Application No. 20192823.1, mailed Dec. 14, 2020 (8 pages).

* cited by examiner

SOLE ELEMENT

CROSS-REFERENCE TO RELATED APPLICATIONS

The present application is a divisional of U.S. patent application Ser. No. 16/941,061, filed Jul. 28, 2020, which claims the benefit of priority from Chinese Patent Application No. 201910826126.7, filed Sep. 3, 2019, and German Patent Application No. 10 2019 213 330.4, filed Sep. 3, 2019. Each of these applications are incorporated herein in their entirety by reference thereto.

TECHNICAL FIELD

The present invention relates to a sole element for an article of footwear, an article of footwear and methods for production thereof.

PRIOR ART

The sole of an article of footwear, such as shoe, is of critical importance both for the wearing comfort perceived by an athlete as well as to enable maximum performance. An important aspect for both wearing comfort and performance is the stiffness of the sole. For example, at walking or gentle running speeds, a flexible sole may be perceived to be more comfortable by an athlete. However, at high running speeds a stiffer sole may be advantageous in order to prevent injury and to improve the performance of an athlete. Frequently, developers are therefore faced with a trade-off in order to provide a sole that is both comfortable, protects a wearer's foot, and enables maximum performance.

U.S. 2017/0157893 A1 discloses an anisotropic composite material assembly comprising a first layer with a tensile modulus different from its compressive modulus and that exhibits variable modulus behavior. The first layer elastically buckles under compression. A second layer has a tensile modulus substantially the same as its compressive modulus. The first and second layers are joined together, and the assembly is bendable in a first direction with an outer surface of the first layer being in compression and the assembly has a first bending stiffness during bending in the first direction. The assembly is bendable in a second direction opposite the first direction with the outer surface of the first layer being in tension, and the assembly has a second bending stiffness greater than the first bending stiffness during bending in the second direction.

However, such anisotropic composite materials are not suitable for providing a complete sole due to their weight and thickness. Unfortunately, such anisotropic composite materials tend to bond poorly to other materials.

WO 2018/118430 A1 discloses a sole plate for an article of footwear comprising a plate body having a first side, a second side, an outer perimeter, at least one opening extending through the plate body from the first side to the second side, and an inner perimeter bounding the at least one opening. The plate body is biased to a first orientation of the inner perimeter relative to the outer perimeter. Such a sole plate offers no anisotropic bending properties.

It is an object underlying the present invention to overcome said disadvantages of the prior art and provide an improved sole for an article of footwear.

SUMMARY OF THE INVENTION

This object is accomplished by the teachings of the independent claims, in particular by a sole element for a cleated article of footwear, in particular a football shoe, including: a composite element with an anisotropic bending property, and a polymer element that at least partially covers the composite element. The anisotropic bending property of the composite element thus bestows an anisotropic bending property upon the sole element for maximum wearing comfort and performance.

The polymer element may include at least one opening on its ground-facing side to expose at least a part of the composite element.

The polymer element may include at least one stud dome for carrying a stud tip, wherein the stud dome and/or the stud tip substantially does not overlap with the composite element.

An embodiment of the invention relates to a sole element for a cleated article of footwear, in particular for a football shoe, that includes: a composite element; a polymer element that at least partially covers the composite element, and wherein the polymer element includes at least one opening to expose at least a part of the composite element. The opening allows a bending property to be engineered since the sole element may bend more easily at the opening than away from the opening. Through the shape of the opening, e.g. elliptical or circular, an easy bending direction may be engineered as required. Thus, an anisotropic bending property may be engineered into the sole element such that the sole element has an anisotropic bending property even with a composite element that itself may not have an anisotropic bending property.

The polymer element may include at least one stud dome for carrying a stud tip, wherein the stud dome may substantially not overlap with the composite element.

The composite element may have an anisotropic bending property.

Another embodiment relates to a sole element for a cleated article of footwear, in particular for a football shoe, that includes: a composite element; a polymer element that at least partially covers the composite element, wherein the polymer element includes at least one stud dome for carrying a stud tip, and wherein the stud dome substantially may not overlap with the composite element. The inventors have found that such a construction may reduce the total weight of the article of footwear and simplify its construction. The polymer element may include at least one opening to expose at least a part of the composite element.

A substantial lack of overlap may mean that there is substantially no overlap looking onto the sole element in a direction perpendicular to a longitudinal direction of the sole plate, e.g. when viewing at a right angle onto a ground-facing surface of the sole element. In particular, "substantially" means that the overlap may be less than 20%, preferably 10% of a cross-sectional area when viewing at a right angle onto a ground-facing surface of the sole element.

In any embodiment, the at least one opening in the polymer element may extend along a longitudinal direction of the sole element. A length along a longitudinal direction of the at least one opening may be greater than a width of the sole element along a direction substantially at right angles to the longitudinal direction. In this way, the sole element may allow for a lateral flexing of a right side relative to a left side of the sole element about a longitudinal axis of the sole element to improve the player's mobility. The at least one opening may be located in a metatarsal region of the sole element.

All described embodiments relate to improved ways of providing optimum bending properties, for example bending stiffness in a sole element.

The cleated article of footwear is preferably a football shoe or football boot. Alternatively, the sole element according to this invention can be used for any other kind of shoe or boot, particularly for athletic activities, for example a running shoe, a tennis shoe, a hiking shoe, a hiking boot, etc.

The anisotropic bending property may be a bending stiffness. Thus, the sole element may have a lower bending stiffness in one direction than in another direction. The composite element may have a lower bending stiffness in one direction than in another direction.

The composite element may thus allow the bending properties of the sole element to be tuned optimally to match the specific requirements regarding a particular requirement. The polymer element bonds well to the composite element allowing a full sole element to be formed that is of a suitable thickness and low weight.

The direction of bending of the sole plays an important role for the wearing comfort and performance of a shoe. The composite element, the sole element, or both the composite element and the sole element may have a first bending stiffness for bending upwards in a toe region of the sole element and a second bending stiffness for bending downwards in the toe region of the sole element, wherein the second bending stiffness is lower than the first bending stiffness.

Thus, the composite element, the sole element, or both the composite element and the sole element may bend more easily in a downward direction than in an upward direction in the toe region of the sole element, in order to enable the sole to engage optimally during running but prevent injury to the foot due to an excessive upwards bending of the toes. Downwards is a direction towards the ground when the article of footwear is worn in its usual configuration. Upwards is a direction towards the sky when the article of footwear is worn in its usual configuration. In other words, the sole element more easily allows a plantar flexion of the foot than a dorsiflexion of the foot.

The inventors have found that a restricted dorsiflexion helps to reduce injury of the foot while an easier plantar flexion allows for optimum performance, for example during running.

The sole element may bend more easily in a downward direction than in an upward direction in the toe region of the sole element, but only until a certain bending angle. The geometry of the ground-facing surface of the sole element may limit the downward bending of the sole element. At some point the studs of the sole element may interact with each other and influence further bending of the sole element. Also, in the upward direction the sole element may get stiffer when you get to a certain bending range, for example 40-45° upward bending. It is also possible that the bending stiffness is the same, for a certain bending range, for an upward and a downward bending. Such bending range may be between 20° upwards an 20° downward bending.

The composite element may be arranged only in a forefoot region of the sole element. The inventors have found that the stiffness provided by the composite element is most important in a forefoot region of the sole element. Thus, this construction allows a preferable degree of stiffness to be provided yet allows for a low total weight of the sole element.

A length of the composite element may be adapted for a particular purpose. For example, it may be advantageous for the composite element to be longer for a cleated article of footwear intended for use on hard ground, e.g. tarmac or polymer-coated concrete or tarmac such as Tartan®, than for a cleated article of footwear intended for use on soft ground, e.g., grass. By alternating the length of the composite element, the overall stiffness of the sole element can be altered, which may influence performance.

As described above, in some embodiments, the polymer element may include at least one stud dome for carrying a stud tip. The studs may be any ground-engaging element, for example for a football boot. The stud dome is preferably manufactured and provided in one-piece with the polymer element. Further, stud tips may be injected on top of the stud domes. Alternatively, the stud tips may be inserted in a first step into recesses of a mold and then the stud domes and the polymer element may be injected onto the stud tips. Alternatively, the stud tips may be screwed into a thread provided in the stud dome. The stud tips may include a different material than the stud domes, preferably the stud tips may include a TPU material which has a high abrasion resistance.

The stud dome may not overlap with the composite element, i.e., the stud dome may not be arranged below the composite element in the usual orientation of the article of footwear during use. Alternatively, the stud tip may not overlap with the composite element, i.e. the stud tip may not be arranged below the composite element in the usual orientation of the article of footwear during use, while at least one of the stud domes is at least slightly overlapping with the composite element in at least one area, especially in the outer periphery of the stud dome.

In order to provide for a lightweight yet strong sole element, a technique called "coring" may be applied behind the studs to provide a hollowed-out stud area. This allows a consistent material thickness of the sole to be provided. If the stud dome would substantially overlap with the composite element, especially overlapping more than the outer periphery of the stud dome, such coring technique would need to be applied to the composite element, which is difficult and expensive, and would reduce the stiffness provided by the composite element.

The polymer element may include a polyamide. Polyamides, such as polyamide 12, have excellent bonding properties.

The composite element may include carbon fiber. Carbon fiber composite materials are lightweight yet exceptionally strong.

The composite element may be at least partially covered by the polymer element on its ground-facing surface, for example, by a 50-65% coverage of the surface area. On the contrary, the top surface of the composite element may be essentially not covered by the polymer element.

Alternatively, the composite element may be essentially fully encapsulated in the polymer element. This arrangement allows for optimum protection of the composite element from dirt and abrasion. A full encapsulation does not necessarily mean that 100% of the surface of the composite element is covered by the polymer element. For example, up to 10%, preferably up to 20% of the surface of the composite element may not be covered by a polymer element, for example to provide an opening as discussed below.

The polymer element may include at least one opening to expose a part of the composite element, for example, on a bottom side (e.g., a ground-facing side) of the composite element. The opening helps to provide sufficient flexibility, i.e. a sufficiently low bending stiffness, in a downward bending direction. Moreover, such an opening is advantageous from a production point of view, since it allows the composite element to be fixed in a mold while the polymer element is injected over the composite element as discussed further below.

A top surface of the sole element may be essentially flat. For example, the top surface may be essentially smooth, i.e., essentially not textured. Such top surface allows easier bonding to further components, e.g., components of the upper or other sole elements.

A contour of the composite element may be essentially smooth. Essentially smooth means that the composite element may be essentially devoid of any sharp features. A sharp feature may be any feature with a width of less than 1 mm, preferably less than 2 mm, most preferably less than 5 mm. The composite element is subject to significant stresses and strains. A sharp contour would be a likely breaking point for the composite element. Thus, this construction allows a more resilient composite element.

The sole element may further include an insole board that is attached to the polymer element. The insole board may provide further stiffness to the sole element. Due to the excellent bonding properties of the polymer, such as a polyamide, the insole board bonds very well to the polymer element.

The insole board may be arranged as a forefoot insole board. The forefoot insole board and the first forefoot region may partially or completely overlap. Thus, it is possible to further tune the bending stiffness of the sole element.

The insole board may include polyether block amide or thermoplastic polyurethane. These materials have good bonding properties and durability.

The sole element and/or the composite element may have a non-linear bending stiffness. Thus, a torque required to bend the sole element and/or the composite element may increase in a non-linear fashion as a function of the bending angle.

The bending stiffness of the sole element and/or the composite element may be less in a first bending range than in a second bending range. For example, a bending stiffness may be smaller for a bending angle below 45 degrees (first bending range) than for a bending angle above 45 degrees (second bending range).

A rear portion of the composite element may be wider than a front portion of the composite element. A front portion of the composite element may be closer to a toe region, while a rear portion of the composite element may be closer to a heel region.

The composite element may further include at least one slit. The at least one slit may help to create better and more tailored bending properties of the sole element. The slit is also advantageous from a production point of view, since it may serve as an injection gate. The slit may be arranged in another area, but preferably is not arranged in an area between a second and a third front row of studs to simplify production and in order to guarantee enough support and comfort to the feet of a wearer. In other words, the slit may not be arranged in the metatarsal region of the sole element.

The slit may be arranged substantially along a longitudinal direction of the sole element. The slit in the composite element may extend in the longitudinal direction from a front-end of the composite element to a rear end of the composite element. In this way, for example, the big toe may have a different flexion than the other toes. Thus, it is possible to further tune the bending stiffness of the sole element to better match the needs of a particular athletic activity.

The invention further concerns a shoe including a sole element as described herein. The shoe thus includes a lightweight, durable sole element that offers optimum support and wearing comfort.

The shoe may further include an upper, wherein a heel region of the upper may be attached to the sole element by sewing. The shoe upper may further be lasted around the insole board in a forefoot region of the sole element. This construction allows a low overall weight while maintaining a good level of stability of the connection of the shoe upper to the sole element.

The invention further relates a method of producing a sole element for an article of footwear, including: providing a composite element with an anisotropic bending property, and over-injecting a polymer element on the composite element to at least partially cover the composite element.

The method may further include forming at least one opening in the polymer element on its ground-facing side to expose a part of the composite element.

The method may further include forming at least one stud dome on the polymer element for carrying a stud tip, wherein the stud dome may not overlap with the composite element.

The invention also concerns a method of producing a sole element for an article of footwear, including: providing a composite element; over-injecting a polymer element on the composite element to at least partially cover the composite element; and forming at least one opening in the polymer element on its ground-facing side to expose a part of the composite element.

The method may further include forming at least one stud dome on the polymer element for carrying a stud tip, wherein the stud dome substantially does not overlap with the composite element.

The composite element may have an anisotropic bending property.

The invention also concerns a method of producing a sole element for an article of footwear, including: providing a composite element; over-injecting a polymer element on the composite element to at least partially cover the composite element; and forming at least one stud dome on the polymer element for carrying a stud tip, wherein the stud dome and/or the stud tip substantially does not overlap with the composite element.

The method may further include forming at least one opening in the polymer element on its ground-facing side to expose a part of the composite element.

The composite element may have an anisotropic bending property.

In any embodiment, the at least one opening in the polymer element may extend along a longitudinal direction of the sole element. A length along a longitudinal direction of the at least one opening may be greater than a width of the sole element along a direction substantially at right angles to the longitudinal direction. This way, the sole element may allow for a lateral flexing of a right side relative to a left side of the sole element about a longitudinal axis of the sole element to improve the player's mobility. The at least one opening may be located in a metatarsal region of the sole element.

All described embodiments relate to improved methods of providing optimum bending stiffness in a sole element. Further details and technical effects and advantages are described in detail above with respect to the sole element.

Over-injecting a polymer element onto the composite element may include any suitable technique known in the art, for example injection molding. The composite element may be fixed in a mold while a liquid polymer element is injected into the mold.

In this way, a good level of bonding between the composite element and the polymer element may be achieved. In particular, small cracks and fissures in the composite element may be filled by the polymer element.

The composite element may have a first bending stiffness for bending upwards in a toe region of the sole element and a second bending stiffness for bending downwards in the toe region, wherein the second bending stiffness may be lower than the first bending stiffness, as discussed in the context of the product above.

The method may further include forming at least one opening in the polymer element to expose a part of the composite element, as discussed above.

The method may further include arranging the composite element in a way in a mold that the opening is formed during the over-injection. For example, the composite element may be clamped with a clamping mechanism at a clamping point during over injection. This may serve to both prevent unintended movement of the composite element during the molding process and provides a simple way of forming openings during over-injection. In particular, one or more openings as described herein may be formed by resting the composite element at a resting point on the surface of the mold. During over-injection, the over-injected material flows around the resting or clamping points resulting in the openings being formed at the resting or clamping point. In a preferred embodiment, raised elements on an inner surface of a first mold part may press the composite element against an inner surface of a second mold part. Thereby, the raised elements of the first mold part act as clamping elements.

The method may further include arranging the composite element only in a forefoot region of the sole element, as already discussed herein. Further details and technical effects and advantages are described in detail above with respect to the sole element.

The method may further include forming at least one stud dome on the polymer element for carrying a stud tip, as discussed herein.

The stud dome may be arranged to not overlap with the composite element, as discussed herein.

The polymer element may include a polyamide, e.g. polyamide 12, as discussed herein.

The over-injecting may include essentially fully encapsulating the composite element in the polymer element, as discussed herein.

The over-injecting may include forming an essentially flat top surface of the sole element, as discussed herein.

The method may further include forming an essentially smooth contour of the composite element, as discussed herein.

The method may further include attaching an insole board to the polymer element, as discussed herein.

The method may further include arranging the insole board in a forefoot region, as discussed herein.

The insole board may include a polyether block amide or thermoplastic polyurethane, as discussed herein.

The sole element and/or the composite element may have a non-linear bending stiffness. The bending stiffness of the sole element and/or the composite element may be less in a first bending range than in a second bending range. For example, a bending stiffness may be smaller for a bending angle below 45 degrees (first bending range) than for bending angle above 45 degrees (second bending range).

The rear portion of the composite element may be wider than a front portion of the composite element, as discussed herein.

The method may further include forming at least one slit in the composite element, as discussed herein.

The slit may be arranged substantially along a longitudinal direction of the sole element, as discussed herein.

The invention further concerns a method of producing a shoe including producing a sole element by a method described herein.

The method of producing a shoe may further include providing an upper and attaching a heel region of the upper to the sole element by sewing. A toe region of the upper may be attached to the sole element by lasting the upper around the sole element, as described herein.

SHORT DESCRIPTION OF THE FIGURES

In the following, exemplary embodiments of the invention are described with reference to the figures.

Figure 5:
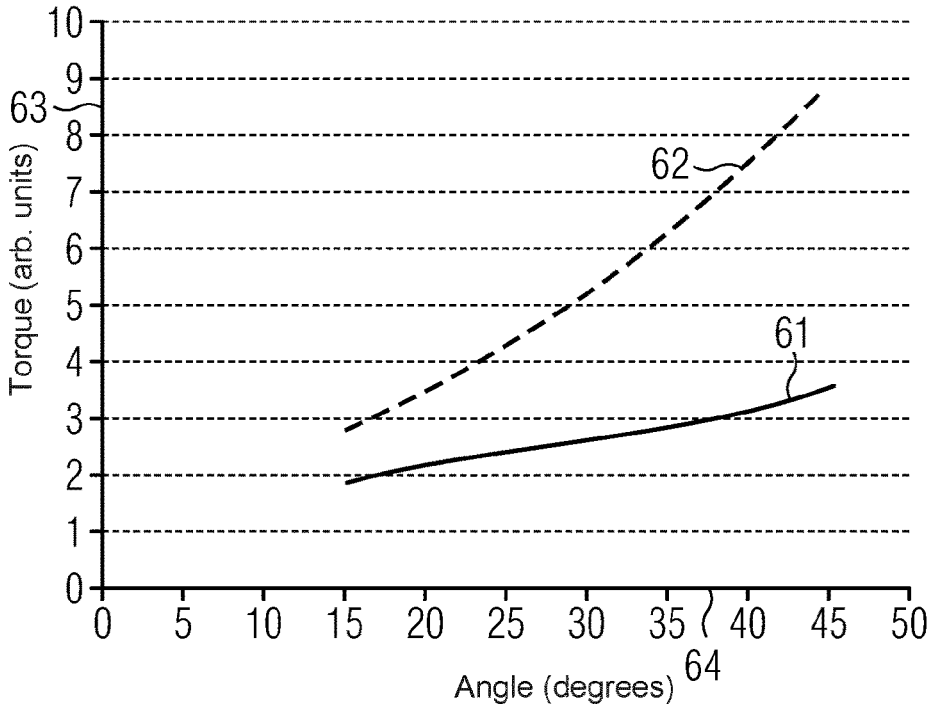
FIG. 5 shows an exemplary torque measurement for a sole element with and without a composite element.
Figure 6:
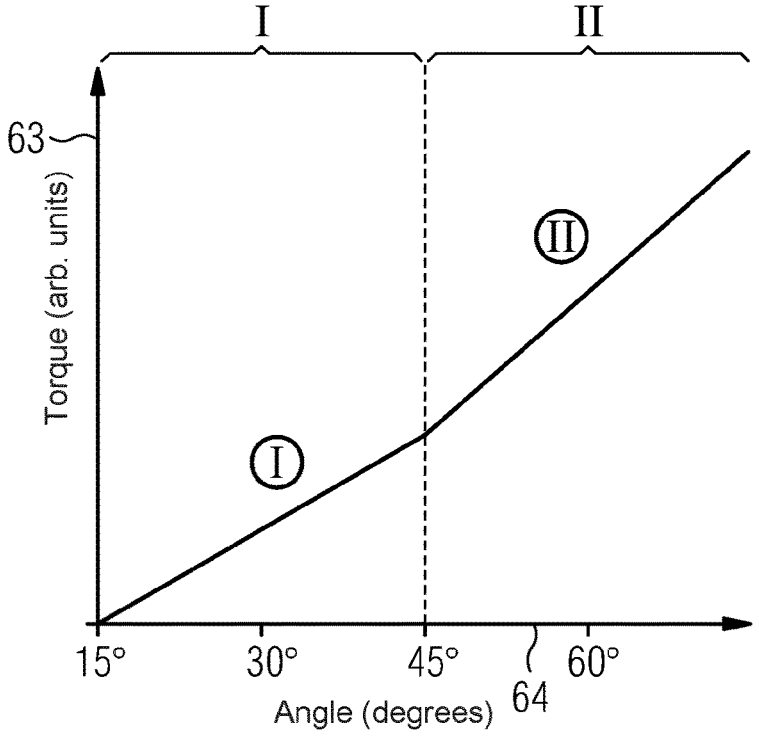

FIG. 6 schematically shows an exemplary torque measurement similar to FIG. 5 to visualize the non-linear bending stiffness of a sole element or a composite element.

Figure 7:
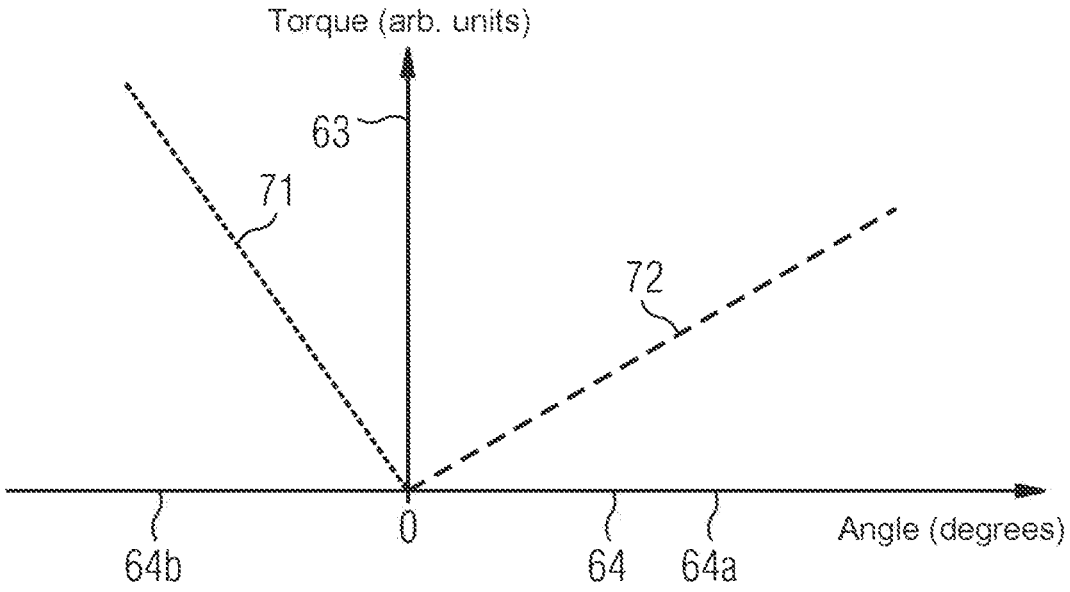

FIG. 7 illustrates an anisotropic bending property of a sole element.

DETAILED DESCRIPTION OF PREFERRED EMBODIMENTS

In the following, some embodiments of the invention are described in detail. It is to be understood that these exemplary embodiments can be modified in a number of ways and combined with each other whenever compatible and that certain features may be omitted in so far as they appear dispensable.

Figure 1:
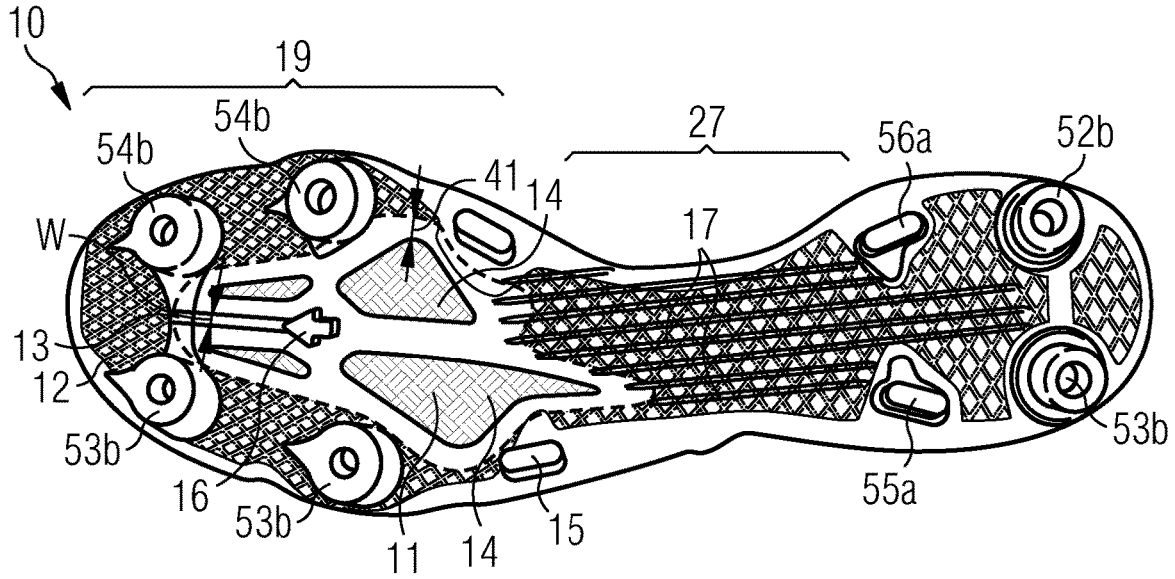
FIG. 1 shows a bottom view of an exemplary sole element according to the present invention.
Figure 2:
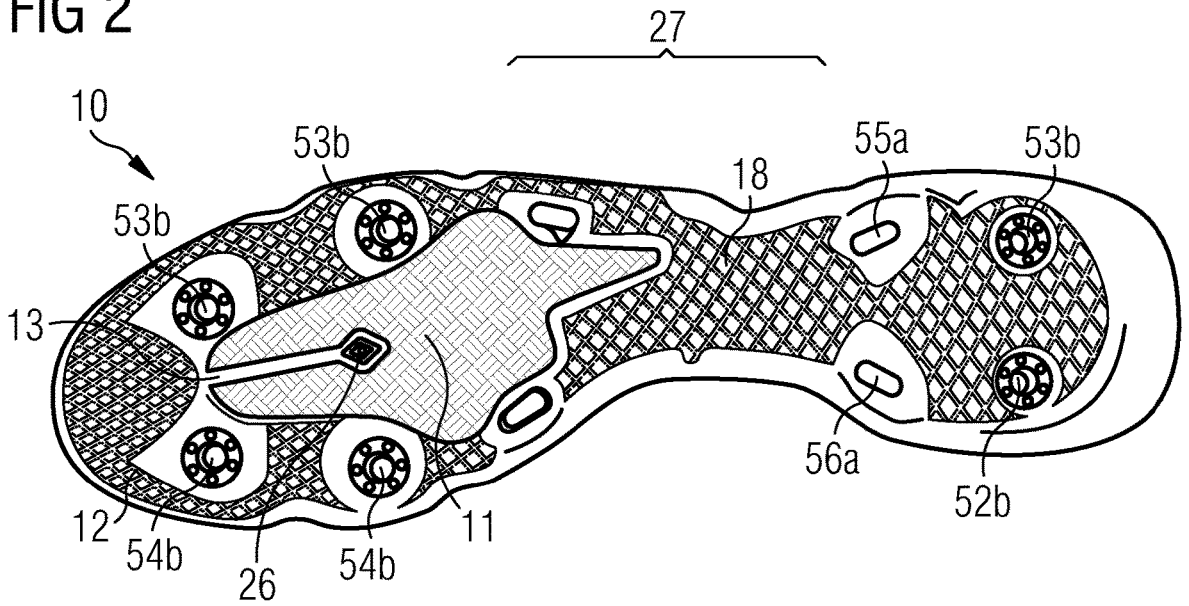
FIG. 2 shows a top view of an exemplary sole element according to the present invention.
Figure 3:
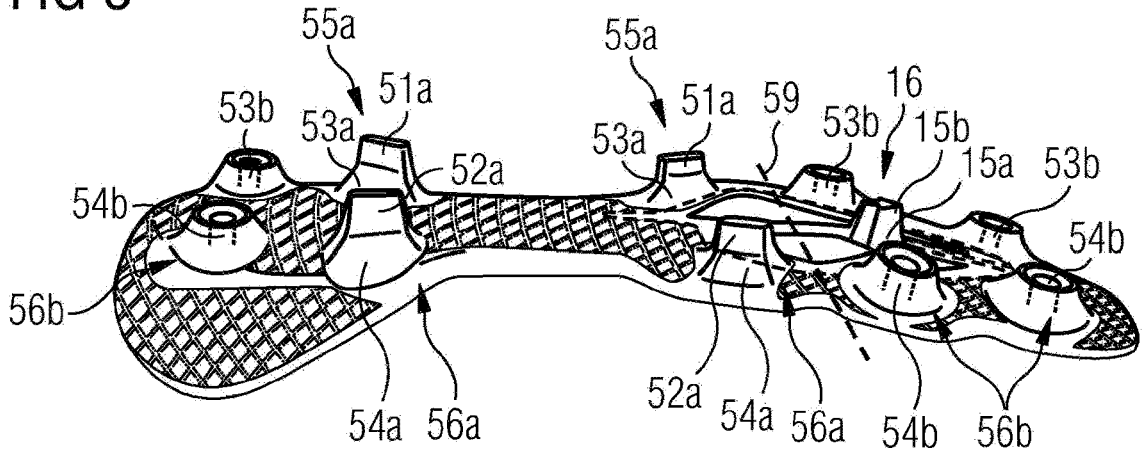
FIG. 3 shows an exemplary lateral view of an exemplary sole element according to the present invention.

FIG. 1 shows a bottom view of an exemplary sole element 10 according to the present invention. FIG. 2 shows a top view of the exemplary sole element 10. FIG. 3 shows a lateral view of the exemplary sole element 10.

Herein, the ground-facing surface of the sole element 10 may be considered as the bottom surface, and the opposite surface of the sole element 10 that is used to be connected to a shoe upper may be considered as the top surface, which is shown in FIG. 2.

The sole element 10 is for an article of footwear and includes: a composite element 11 with anisotropic bending properties, and a polymer element 12 that at least partially covers the composite element 11.

The composite element 11 with anisotropic bending properties has a lower bending stiffness in one direction than in another direction. In this example, the composite element 11 has a first bending stiffness for bending upwards in a toe region of the sole element and a second bending stiffness for bending downwards in the toe region of the sole element 10, wherein the second bending stiffness is lower than the first bending stiffness. Thus, the composite element 11 bends more easily downwards than upwards in the toe region of the sole element 10. Therefore, the sole element 10 more easily allows a plantar flexion of the foot than a dorsiflexion of the foot.

The composite element 11 may include carbon fiber and has a thickness of approximately 1.3 mm.

The polymer element 12 may include any thermoplastic material suitable for over-injection manufacture, for example polyamide 12. The polymer element 12 is over-injected to cover at least partially the composite element 11 on the bottom surface of the sole element 10, i.e. the ground-facing surface as shown in FIG. 1.

The exemplary polymer element 12 comprises two stud domes 53*a* for a lateral over-injected stud, three stud domes 53*b* for a lateral screwable stud, two stud domes 54*a* for a medial over-injected stud, three stud domes 54*b* for a medial screwable stud, and a central stud dome for carrying a central stud tip.

The combination of a stud dome and a stud tip is referred to as a stud. Two stud tips 51*a* are integrally connected with the two stud domes 53*a* for a lateral over-injected stud thus forming a lateral over-injected stud 55*a*. Lateral screwable stud tips are not shown but are to be screwed into the three stud domes 53*b* for a lateral screwable stud for forming a lateral screwable stud 53*b*. Two medial over-injected stud tips 52*a* are integrally connected with the three stud domes 54*a* for a medial over-injected stud thus forming a medial over-injected stud 56*a*. Medial screwable stud tips are not shown but are to be screwed into the three stud domes 54*b* for a medial screwable stud 56*b*. A central stud tip 15*b* is integrally connected with a central stud dome 15*a* forming a central stud 16. In an embodiment the stud tips 51*a*, 52*a*, 15*b* may be inserted in a first step into recesses of a mold and then the stud domes 53*a*, 53*b*, 54*b*, 15*a* and the polymer element 12 are injected onto the stud tips 51*a*, 52*a*, 15*b*.

This arrangement is best shown in FIG. 3. The stud domes are manufactured in one-piece with other parts of the polymer element 12 and thus include the same polymer material as the polymer element 12, e.g., polyamide 12. The stud tips can be made of, for example, thermoplastic polyurethane (TPU).

The composite element 11 is arranged only in a forefoot region 19 of the sole element 10. The forefoot region 19 is located in a front portion of the sole element 10 which is larger than and not identical to the forefoot region 19. The front portion of the sole element 10 may be closer to a toe region, opposing a rear portion of the sole element 10 which may be closer to a heel region.

The composite element 11 is arranged in the front portion of the sole element 10 in a way that the composite element 11 substantially does not overlap with any of the stud domes 53*a*, 53*b*, 54*a*, 54*b*, or 15*a* of the polymer element 12. Therefore, the studs 55*a*, 55*b*, 56*a*, 56*b*, and 16 in the respective stud domes 53*a*, 53*b*, 54*a*, 54*b*, or 15*a* in the front portion do not overlap with the composite element 11 either. As shown in FIG. 1, said in other words, the studs 55*a*, 55*b*, 56*a*, 56*b*, and 16 are not arranged above the composite element 11 when one looks at the sole element 10 from the ground-facing surface.

Alternatively, it is also possible that the composite element 11 is arranged in the front portion of the sole element 10 in a way that the composite element 11 substantially does not overlap with any of the stud tips 51*a*, 52*a*, 15*b*, but at least one of the stud domes 53*a*, 53*b*, 54*a*, 54*b*, or 15*a* of the polymer element 12 is slightly overlapping with the composite element 11 in its outer periphery.

The slit 13 is arranged substantially along a longitudinal direction of the sole element 10 and extends in the longitudinal direction from a front end of the composite element 11 to a rear end of the composite element 11. This way, for example, the big toe may have a different flexion than the other toes.

As shown in FIG. 1, the slit 13 is arranged in the toe region of the sole element 10 in between the first two lateral stud domes 53*b* and the first two medial stud domes 54*b*. It should be noted that the slit 13 extends to the location of the central stud 16 such that the central stud 16 substantially does not overlap with the composite element 11 as mentioned above.

The slit 13 may be arranged in another area of the composite element 11. However, it is preferred that the slit is not arranged in the metatarsal region of the sole element in order to guarantee enough support and comfort to the feet of a wearer. Alternatively, the composite element 11 might include more than one slit 13. For example, two substantially parallel slits might be used. Other arrangements of more than one slit may be possible.

Further, the slit 13 may serve as an injection gate during manufacturing.

In this example, the bottom surface of the composite element 11 (i.e., the ground-facing surface as shown in FIG. 1) is covered by the polymer element 12 roughly by a 50-65% of the surface area. On the contrary, the top surface of the composite element 11 (shown in FIG. 2) is essentially not covered by the polymer element 12. The top surface of the composite element 11 is essentially smooth. In other embodiments, the composite element 11 may be fully encapsulated by the polymer element 12 by any preferred percentage of the surface area.

As shown in FIG. 1, the polymer element 12 includes two openings 14 to expose a part of the composite element 11 on a bottom side of the polymer element 12. The bottom side is the ground-facing side of the polymer element 12. During production, the composite element 11 is fixed in a mold at a resting point while the polymer element 12 is injected over the composite element 11 thus forming the openings 14. Alternatively, the polymer element can include more or less than two openings 14.

On the top side of the sole element 10 as shown in FIG. 2, the composite element 11 is arranged substantially at the middle of the front portion of the sole element 10 and surrounded by the polymer element 12. The polymer element 12 includes a first bonding margin at its periphery for attaching a shoe upper to the sole element 10. The first bonding margin is preferably with a width of 8 mm to 10 mm at the periphery to provide a strong bonding of the sole element 10 to a shoe upper.

A contour of the composite element 11 is essentially smooth. The composite element 11 is essentially devoid of any sharp features with a width of less than 2 mm, wherein a width is measured between two parallel and opposite portions of the composite element 11. Note that the slit 13 has a width w but does not provide any sharp features. The composite element 11 has a smooth contour on either side of the slit 13 with a width greater than width w.

In other embodiments, the sole element 10 may further include an insole board that is attached to the polymer element 12. The insole board may provide further stiffness to the sole element 10. Due to the excellent bonding properties of the polymer, such as a polyamide, the insole board bonds very well to the polymer element 12.

The insole board may be arranged as a forefoot insole board. The forefoot insole board and the first forefoot region 19 may partially or completely overlap. Thus, it is possible to further tune the bending stiffness of the sole element.

The insole board may include polyether block amide or thermoplastic polyurethane. These materials have good bonding properties and durability.

The sole element 10 may include a plurality of ribs 17 in a midfoot region 27 on the bottom surface to advantageously increase the stiffness of the midfoot region 27 without increasing the weight of the sole element 10.

The sole element 10 may include a lattice structure 18 in a midfoot region 27, which further provides improved stiffness while allowing for some torsional movement of the front and rear portions of the sole element 10 relative to each other. Moreover, the weight of the sole element 10 is reduced compared to a more solid construction.

The ribs 17 and lattice structure 18 in combination with the usage of the polyamide material of the polymer element 12 create a very light sole element 10 which has the right stiffness on the other hand. By tuning the ribs 17 and lattice structure 18, the stiffness and weight of the sole element 10 can be adjusted as desired.

The top surface of the sole element 10 is essentially flat and essentially smooth, i.e. essentially not textured, as shown on FIG. 2.

A second bonding margin 41 is formed around the openings 14 of at least 5 mm and overlaps between the polymer element 12 and the composite element 11 in order to ensure good bonding strength.

Figure 4A:
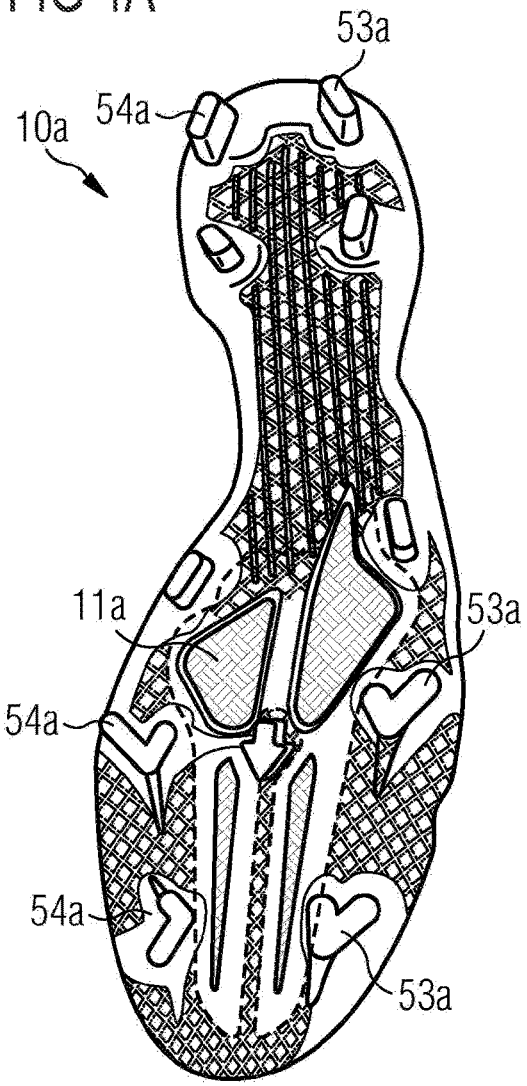
FIG. 4A shows an exemplary bottom view of an exemplary sole element according to the present invention.
Figure 4B:
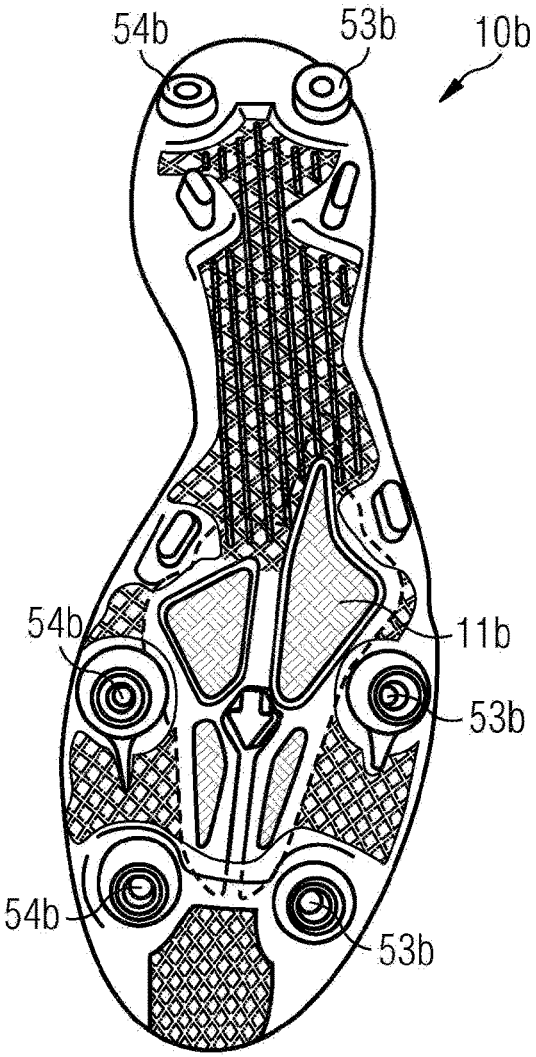
FIG. 4B shows an exemplary bottom view of an exemplary sole element according to the present invention.

FIGS. 4A and 4B show two exemplary bottom views of exemplary sole elements 10*a*, 10*b* similar to the one shown in FIGS. 1-3. The composite element 11*a* of sole element 10*a* is longer than the composite element 11*b* of sole element 10*b*. Sole element 10*a* does not include any screwable studs. Sole element 10*b* includes stud domes 53*b* and 54*b* for screwable studs, whereas the corresponding stud domes 53*a* and 54*a* of sole element 10*a* are for over-injected studs. Sole element 10*a* is configured for use on hard ground while sole element 10*b* is for use on soft ground.

FIG. 5 shows an exemplary torque measurement for a sole element with and without a composite element. A vertical axis 63 shows the torque required to bend a sole element by a certain angle shown on the horizontal axis 64 about bending axis 59 shown in FIG. 3. Two curves are shown. Curve 61 shows the required torque for bending the sole element about the bending axis 59 without a composite element. Curve 62 shows the required torque for bending the sole element about the bending axis 59 with a composite element. A higher required torque for a given angle indicates a higher bending stiffness. Hence, the bending stiffness is increased by the presence of the composite element.

FIG. 6 schematically illustrates an exemplary torque measurement similar to the one shown in FIG. 5 to visualize the non-linear bending stiffness of a sole element or a composite element. A vertical axis 63 shows the torque required to bend a sole element by a certain angle shown on the horizontal axis 64 about a bending axis, e.g. bending axis 59 shown in FIG. 3. For the example schematically illustrated in FIG. 6, a wedge element was placed under the heel portion of the sole prior to testing. The wedge has an angle of 15°. That is the reason why the horizontal axis 64 in FIG. 6 starts at 15° as opposed to 0°; 15° is relative to horizontal, in which 0° would equate to the rear portion of the sole being horizontal. The wedge is placed under the heel portion to create a normalized starting position, which is necessary because the sole element 10 is not perfectly horizontal from toe-to-heel in an unloaded condition. In other words, it is necessary to normalize the plates with the help of the wedge element because different sole elements have a different toe lift in an unloaded condition. Additionally, 15° is a more realistic starting position considering the outsole end use case. As can be seen in FIG. 6, the curve has a non-linear bending stiffness. In area I, the bending stiffness is less than that of the bending stiffness after 45° in area II. That means in area I (0-45 degree) the sole element or composite element has a first stiffness, and in area II it has a second stiffness (45 degrees and upwards).

FIG. 7 schematically illustrates an anisotropic bending property of a sole element or a composite element. A vertical axis 63 shows the torque required to bend a sole element by a certain angle shown on the horizontal axis 64 about a bending axis, e.g., bending axis 59 shown in FIG. 3. Two curves are shown. Curve 71 shows the required torque for bending the sole element about the bending axis 59 for negative angles 64*b*. Curve 72 shows the required torque for bending the sole element about the bending axis 59 for positive angles 64*a*. As can be seen, for a given magnitude of the angle, the required torque is much higher for negative angles 64*b* than for positive angles 64*a*. Thus, a bending property, in this case a bending stiffness of the sole element is anisotropic. A positive angle may correspond to downwards bending or plantar flexion of the foot, while a negative angle may correspond to upwards bending or dorsiflexion of the foot.

Some embodiments described herein relate to a sole element for a cleated article of footwear, in particular for a football shoe, that comprising a composite element; a polymer element that at least partially covers the composite element, and wherein the polymer element comprises at least one opening on its ground-facing side to expose at least a part of the composite element.

Some embodiments described herein relate to a sole element for a cleated article of footwear, in particular for a football shoe, comprising a composite element; a polymer element that at least partially covers the composite element, wherein the polymer element comprises at least one stud dome for carrying a stud tip, and wherein the stud dome and/or the stud tip substantially does not overlap with the composite element.

In some embodiments, the composite element comprises an anisotropic bending property.

In some embodiments, the composite element is arranged only in a forefoot region of the sole element.

In some embodiments, the polymer element comprises a polyamide.

In some embodiments, a top surface of the sole element is essentially flat.

In some embodiments, a contour of the composite element is essentially smooth.

In some embodiments, the sole element comprises an insole board that is attached to the polymer element, and the insole board is a forefoot insole board.

Some embodiments described herein relate to a shoe comprising a sole element as described herein, and further comprising an upper, wherein a heel region of the upper is attached to the sole element by sewing.

Some embodiments described herein relate to a method of producing a sole element for an article of footwear, comprising providing a composite element with an anisotropic bending property; and over-injecting a polymer element on the composite element to at least partially cover the composite element.

Some embodiments described herein relate to a method of producing a sole element for an article of footwear, comprising providing a composite element; over-injecting a polymer element on the composite element to at least partially cover the composite element; and forming at least one stud dome on the polymer element for carrying a stud tip, wherein the stud dome and/or the stud tip does not overlap with the composite element.

In some embodiments, the method further comprises forming at least one opening in the polymer element to expose a part of the composite element.

In some embodiments, the method further comprises arranging the composite element only in a forefoot region of the sole element.

In some embodiments, the polymer element comprises a polyamide.

In some embodiments, over-injecting comprises forming an essentially flat top surface of the sole element.

In some embodiments, the method further comprises forming an essentially smooth contour of the composite element.

In some embodiments, a rear portion of the composite element is wider than a front portion of the composite element.

In some embodiments, the method further comprises providing an upper and attaching a heel region of the upper to the sole element by sewing.

REFERENCE SIGNS

10: sole element
11: composite element
12: polymer element
13: slit
14: opening
15*a*: central stud dome
15*b*: central stud tip
16: central stud
17: ribs
18: lattice structure
19: forefoot region
26: stud dome for central stud
27: midfoot region
30: shoe
31: shoe upper
41: second bonding margin
42: distance from sidewall
51*a*: lateral over-injected stud tip
52*a*: medial over-injected stud tip
53*a*: stud dome for lateral over-injected stud
53*b*: stud dome for lateral screwable stud
54*a*: stud dome for medial over-injected stud
54*b*: stud dome for medial screwable stud
55*a*: lateral over-injected stud
55*b*: lateral screwable stud
56*a*: medial over-injected stud
56*b*: medial screwable stud
59: bending axis
61: torque without composite element
62: torque with composite element
63: vertical axis
64: horizontal axis
64*a*: positive angles
64*b*: negative angles
71: torque for negative angles
72: torque for positive angles

What is claimed is:

1. A method of producing a sole element for an article of footwear, comprising:

providing a composite element;

over-injecting a polymer element on the composite element to at least partially cover the composite element; and forming at least one opening in the polymer element on its ground-facing side to expose a part of the composite element.

2. The method according to claim 1, further comprising forming at least one stud dome on the polymer element for carrying a stud tip at a location wherein the stud tip does not overlap with the composite element.

3. The method according to claim 1, wherein the composite element comprises an anisotropic bending property.

4. The method according to claim 1, wherein the composite element has a first bending stiffness for bending upwards in a toe region of the sole element and a second bending stiffness for bending downwards in the toe region, wherein the second bending stiffness is lower than the first bending stiffness.

5. The method according to claim 1, wherein over-injecting comprises covering at least partially a ground-facing surface of the composite element by the polymer element.

6. The method according to claim 1, further comprising attaching an insole board to the polymer element.

7. The method according to claim 1, further comprising forming a slit in the composite element, wherein the slit is arranged substantially along a longitudinal direction of the sole element.

8. A method of producing a shoe comprising producing a sole element by a method according to claim 1.

9. The method of claim 7, wherein over-injecting the polymer element comprises using the slit as an injection gate.

10. The method of claim 1, comprising clamping the composite element during the over-injecting the polymer element.

11. The method of claim 10, wherein clamping the composite element comprises applying a clamping mechanism to contact the composite element at a clamping point, and forming the at least one opening comprises forming the at least one opening at the clamping point.

12. The method of claim 11, wherein over-injecting the polymer element comprises causing over-injected material to flow around the clamping point to form the at least one opening.

13. The method of claim 10, comprising over-injecting the polymer element within a mold comprising a first mold part and a second mold part, and wherein the clamping element comprises a raised element of the first mold part.

14. The method of claim 1, comprising over-injecting the polymer element within a mold and resting the composite element at a resting point on a surface of the mold, and wherein forming the at least one mold opening comprises forming the at least one mold opening at the resting point.

15. The method of claim 14, wherein over-injecting the polymer element within the mold comprises causing over-injected material to flow around the resting point to form the at least one opening.

16. The method of claim 2, wherein the sole element comprises studs comprising the stud domes, and the studs are configured to interact with each other to influence bending of the sole element.

17. The method of claim 2, wherein the sole element comprises studs comprising the stud domes, the studs are arranged in a first row, a second row, and a third row in order of distance from a front end of the sole element, and the sole element comprises a slit arranged outside of an area defined between the second row and the third row.

18. The method of claim 17, wherein over-injecting the polymer element comprises using the slit as an injection gate.

* * * * *